US010619405B2

(12) United States Patent
Leontaridis

(10) Patent No.: US 10,619,405 B2
(45) Date of Patent: Apr. 14, 2020

(54) JOINT FOR THE ANGULAR CONNECTION OF HOLLOW PROFILE MEMBERS AND METHOD USING SUCH JOINT

(71) Applicant: Athanasios Leontaridis, Kallithea Attikis (GR)

(72) Inventor: Athanasios Leontaridis, Kallithea Attikis (GR)

( * ) Notice: Subject to any disclaimer, the term of this patent is extended or adjusted under 35 U.S.C. 154(b) by 0 days.

(21) Appl. No.: 15/777,046

(22) PCT Filed: Nov. 18, 2016

(86) PCT No.: PCT/GR2016/000062

§ 371 (c)(1),
(2) Date: May 17, 2018

(87) PCT Pub. No.: WO2017/085521

PCT Pub. Date: May 26, 2017

(65) Prior Publication Data

US 2018/0334848 A1 Nov. 22, 2018

(30) Foreign Application Priority Data

Nov. 18, 2015 (GR) ..... 20150100500

(51) Int. Cl.
*E06B 3/972* (2006.01)
*E06B 3/98* (2006.01)
(Continued)

(52) U.S. Cl.
CPC ..... *E06B 3/972* (2013.01); *E06B 3/06* (2013.01); *E06B 3/9688* (2013.01); *E06B 3/982* (2013.01); *E06B 3/9685* (2013.01); *E06B 3/9725* (2013.01)

(58) Field of Classification Search
CPC ..... E06B 3/972; E06B 3/06; E06B 3/9688; E06B 3/982; E06B 3/9685; E06B 3/9725
(Continued)

(56) References Cited

U.S. PATENT DOCUMENTS 3,782,054 A * 1/1974 Goss, Jr. ..... E06B 3/9682 40/782
3,848,390 A * 11/1974 Anderson ..... E06B 3/982 403/401
(Continued)

FOREIGN PATENT DOCUMENTS

FR 2904068 A1 1/2008
WO 2004033837 A 4/2004

*Primary Examiner* — Joshua K Ihezie

(57) ABSTRACT

Joint for the angular connection of a pair of hollow profile members (50) having an angular configuration corresponding to the angle of the assembled profile members (50) and comprising a slide base portion (2, 2', 2"), a sheet metal portion (1, 1') superimposed thereupon and a bolt (5) passing through the sheet metal portion (1, 1') and screwed into a nut (4) mounted onto the base portion (2, 2', 2"), wherein tightening of bolt (5) pushes upwardly extending surfaces on either side of portion (1, 1') whereby their sharp edges indent the walls of the hollow profile members being connected. The indentation and efficient angular connection of the hollow profile members is enhanced through: a) forming of the sharp edges of the sheet metal to align an aberrant edge thereof in an indentation appropriate direction, b) appropriately orienting the sheet metal portion (1, 1') to comply with a set of predetermined geometrical parameters and c) selectively employing varying embodiments of the slide base portion to obtain rapprochement of the points of indentation of the walls being indented.

10 Claims, 10 Drawing Sheets

(51) Int. Cl.
*E06B 3/968* (2006.01)
*E06B 3/06* (2006.01)

(58) Field of Classification Search
USPC ..... 52/204.5, 656.1, 656.9, 655.1, 656.4, 52/656.5, 656.6; 403/297, 402
See application file for complete search history.

(56) References Cited

U.S. PATENT DOCUMENTS

| | | | | |
|---|---|---|---|---|
| 3,967,910 | A * | 7/1976 | Tollefsrud | E06B 3/9725 403/402 |
| 4,076,438 | A * | 2/1978 | Bos | E06B 3/982 403/297 |
| 6,042,298 | A * | 3/2000 | Mastrogiannis | E06B 3/9725 403/402 |
| 7,509,780 | B2 * | 3/2009 | Leontaridis | E06B 3/982 403/297 |
| 2006/0059843 | A1 * | 3/2006 | Leontaridis | E06B 3/982 52/656.1 |
| 2008/0152849 | A1 * | 6/2008 | Lenhardt | E06B 3/667 428/34 |
| 2008/0263973 | A1 * | 10/2008 | Lenhardt | E06B 3/667 52/204.591 |

* cited by examiner

JOINT FOR THE ANGULAR CONNECTION OF HOLLOW PROFILE MEMBERS AND METHOD USING SUCH JOINT

THE FIELD OF THE ART

The invention relates to a joint employed in the process of angular connection of hollow profile members used to form parallelepipedal frames for doors or windows such frames being filled with glazing or shutter panels.

THE BACKGROUND OF THE INVENTION

A variety of joints is used in the angular connection of hollow profile members with their edges being cut at an angle of 45° and brought in matching contact to form door or window frames, partitions or other applications. The hollow profile members are cut at an angle of 45° in each corner of the generally rectangular frame of either the frame profile member that is fixedly mounted onto the wall surrounding a door or window opening or of the sash profile member operationally mounted therein. A joint item is thereafter being introduced within abutting chambers of a pair of hollow profile members being brought in matching contact at each one of the corners of the aforementioned generally rectangular frame, the joint providing a stable connection of such profile members.

Prior art joints generally comprised spring activated button means detachably engaging into suitable apertures provided at the corners of the hollow profile members being connected, such joints being adapted to stabilize the angular connection thereof. These prior art joints required, prior to employment thereof, the opening of apertures at accurately selected locations of the hollow profile members wherein are engaged the abovementioned spring activated buttons. This process is awkward and time consuming due to the accuracy required in marking and drilling of the apertures and often leads to an imperfect fit of the profiles and to a structure of reduced aesthetics and functionality due to the erroneous alignment of the hollow profile members brought in matching contact or to a loosening of tightening of the joint in the course of time.

WO 2004/033837 of Athanasios Leontaridis discloses a joint for the angular connection of frames for doors and windows, such joint comprising a slide base portion with side parts inserted within the abutting chambers of a pair of hollow profile members being connected and an analogously configured sheet metal mobile portion superimposed thereupon, the sheet metal mobile portion including upwardly extending legs with indenting edges, a bolt passing through a single hole that is required in this disclosure, ach bolt being employed in the tightening process of the joint, wherein after the joint has been inserted into the hollow profile members being brought together for connection, the bolt acts so as to exert an upwardly raising force onto the sheet metal mobile portion, whilst maintaining the slide base portion at a fixed position, and subsequently leading the sharp indenting edges of the sheet metal portion to produce an indentation effect into the walls of the corresponding chambers of the hollow profiles being angularly connected with the joint, as the bolt is being tightened, thereby resulting in a robust, self aligned connection of the hollow profile members. The hereinabove angular joint disclosed in WO-2004/033837 with its symmetrical arrangement on either side of a plane of symmetry passing though the plane of matching contact of the hollow profile members being connected has contributed in overcoming the aforementioned problems of joints of the prior art, since it substantially facilitates the user, i.e. the technician who assembles doors or windows through angularly connecting previously cut profile lengths to produce the frames, which must subsequently filled, e,g, with a glass panel or a shutter. The user is in particular facilitated due to the requirement of a single handily marked and drilled hole in place of the plurality of holes posing awkward precision marking and drilling requirements in the angular joints of the prior art, thereby providing a decreased cost in the usage thereof. Furthermore, the joint disclosed in WO-2004/033837 has provided a strong and reliable connection that in the course of time is much less vulnerable in preserving its high standard of performance.

However, whilst the hereinabove described joint that was disclosed in WO 2004/033837 has had a warm international welcome, the extensive use thereof highlighted a drawback related to its use for the angular connection of hollow profile members of relatively larger dimensions, wherein the upwardly bent sections of the sheet metal mobile portion being adapted to indent the walls of the chambers of the hollow profile members being connected have to extent at a long distance thereby resulting in a deficient and uncertain indentation of the sharp edges thereof into the walls of the chambers of the hollow profile members being connected.

It has in particular been established that certain geometrical parameters applicable in the manufacturing of the joint that specifically relate to the slope of the upwardly extending members of the sheet metal mobile portion and of the geometry of impact thereof onto the walls of the hollow profile members being indented do play a significantly important role in achieving an optimum indentation into the walls of the hollow profile members being connected. An important role is also played by the angle formed by the wall of the chambers of the hollow profile members being connected onto which is mounted the base portion of the joint with a straight line passing through a terminal point E1 of contact of the inwardly bent side surface of the sheet metal mobile portion with the section surface of the base portion prior to the upward bending thereof into the upwardly extending member and through a point E2 of impact of the upwardly extending member of the sheet metal mobile portion onto the opposing wall of the chambers of the hollow profile members being connected. The angle formed by the wall of the hollow profile members being indented with a line transversally crossing the indenting edge of the sheet metal mobile portion is also important. It has further been observed that the aimed indentation of the edges of the sheet metal mobile portion onto the walls of the aforementioned chambers is deficient because of an aberrant sharp edge thereof that is being created at one side of a terminal edge of the sheet metal during the cutting process from a sheet metal web.

It is therefore an object of this invention to provide advantageous modifications of the joint disclosed in WO 2004/033837 with a scope of addressing the abovementioned disadvantages and shortcomings through the disclosure of new features of the slide base portion and of the sheet metal mobile portion superimposed thereupon and of certain geometrical parameters thereof so as to improve and to strengthen the capacity of the upwardly extending members of the sheet metal mobile portion to achieve an efficient indentation of the walls of the chambers of the hollow profile members being connected regardless of the dimensions of the latter.

This object of the invention is achieved by optimizing the design and the orientation of the sheet metal mobile portion as will be described in detail hereinafter:

a) providing the slide base portion with upwardly bent terminal side surfaces, thereby forming sockets on either side thereof appropriately configured for nesting the equivalently bent terminal side surfaces of the sheet metal mobile portion.

b) treating the sharp edges of the sheet metal mobile portion following cutting thereof from a sheet metal web with a scope of alignment in the longitudinal direction of the sheet metal mobile portion of an aberrant sharp edge resulting from the cutting blade having been driven perpendicularly into the web of the sheet metal, thereby obtaining an appropriate form of the sharp edges that would facilitate indentation of the walls of the hollow profile members being connected.

c) selectively orienting the upwardly bent members of the slide base portion and of the sheet metal mobile portion with a scope of complying with certain predetermined geometrical parameters to be described hereinafter, including providing the sheet metal mobile portion with a zigzag extension of the upwardly bent member thereof in the case of use of the joint in the connection of hollow profile members having chambers with larger dimensions.

Additionally or alternatively, the above object is being achieved through use of a slide base portion that advantageously approaches the region of the walls in the chambers of the hollow profile members being connected wherein the indentation of the sheet metal mobile portion takes place, such effect being obtained with the employment of an elevated slide base portion that achieves rapprochement of the walls of the chambers intended to be indented by the sheet metal mobile portion, the same result being alternatively achieved by using the standard slide base portion in combination with an additional base raising member provided with legs adapted to raise the slide base portion at a desired level for the sheet metal mobile portion to effect an efficient indentation of the walls of chambers of the hollow profile members being connected, as well as by using a specially configured slide base portion of the type of joints being used in association with a mechanical press assembly comprising cutting blades used to cut strips of material of the walls of the hollow profile members being connected and embed such strips within specially configured recesses on either side of the slide base portion. This last method of connection of hollow profile members to form frames for doors and windows as used in the prior art requires the single element of the joint to have side arms that firmly fit within the chambers of the hollow profile members being connected and are glued therein prior to employment of the mechanical press assembly and as a result a poor performance thereof might result from use of the press assembly and embedding of the aforementioned strips before the glue has adequately dried. Further this method of angular connection of profiles necessitates use of joints of varying sizes to fit chambers of correspondingly varying sizes, thereby increasing costs.

It is therefore a further object of the invention to propose an embodiment of the joint of the invention wherein the slide base portion is provided with side parts firmly fitted within chambers of the hollow profile members being brought in matching contact and a sheet metal portion with indenting sides is superimposed thereupon, whereby the employment of the mechanical press assembly that is used in the prior art with a scope of cutting strips of material of the walls of the chambers to embed them within recesses of the joint or the use of glue to stabilize the connection is merely an optional choice and not a necessary requirement.

These and other objects, characteristics and advantages of the present invention over the prior art will become apparent in the detailed description hereinbelow.

SUMMARY OF THE INVENTION

The abovementioned object of achieving an improved strong, handy and low cost angular connection of hollow profile members is implemented with a joint comprising a slide base portion fixedly mounted within chambers of a pair of hollow profile members being brought in matching contact and a sheet metal mobile portion superimposed thereupon and adapted to move through tightening of a bolt passing along the plane of matching contact of the profile members being connected that also is the plane of symmetry (xx') of the joint until the sharp edges of its upwardly extending sides appropriately indent the walls of the chambers and effect a strong connection of the pair of hollow profile members, wherein the sheet metal mobile portion is manufactured from a hard metal (e.g. steel) substantially harder than the material of construction of the walls of the chambers being indented (e.g. aluminium or plastic), wherein the joint of the present invention satisfies the following characteristics:

The slide base portion extends on either side into an upwardly bent terminal side surface being oriented in a direction parallel to the plane of symmetry (xx'), wherein these upwardly bent terminal side surfaces in association with the side parts of the slide base portion define sockets adapted to nest the upwardly bent surfaces with sharp indenting edges of the sheet metal mobile portion.

A sharpened edge of the upwardly bent surfaces of the sheet metal mobile portion is formed through alignment in the longitudinal direction of the mobile portion of an aberrant sharp edge resulting from a cutting blade being driven perpendicularly into a web of the sheet metal used in the manufacture of the sheet metal mobile portion.

The sheet metal mobile portion has a structure that complies with a set of geometrical parameters as follows:

- an angle (a) formed by each one of the upwardly bent terminal side surfaces of the sheet metal mobile portion with a corresponding wall of each one of the pair of chambers of the hollow profile members whereupon the slide base portion is being mounted, has a minimum value of 45°;
- an angle (b) formed by a wall of each one of the pair of chambers of the hollow profile members whereupon the slide base portion is being mounted with a straight line passing through a terminal point (E1) of contact of an inwardly bent side surface of the sheet metal mobile portion with a side section of the slide base portion wherein is nested the above inwardly bent side surface of the sheet metal mobile portion and through a terminal point (E2) of impact of the sharp edge of the sheet metal mobile portion respectively onto the opposing walls of the chambers of the hollow profile members being connected, has a value of the order of 60°, and
- an angle (c) formed by a wall of the chambers of the hollow profile members being indented by the sheet metal mobile portion with a line transversally crossing the sharp edge of the sheet metal mobile portion has a value within a preferred range of 45°-55° and preferably a value of the order of 45°.

In accordance with an embodiment of the invention, the upwardly bent sides with the sharp indenting edges of the sheet metal mobile portion are provided with a zigzag extension that advantageously displaces the point of impact onto the walls being indented in a desired position that ensures optimal indenting of the walls of chambers of the hollow profile members being connected, such zigzag extension comprising a first segment being provided past a first bending point located at the end of the upwardly extending terminal side surface of the slide base portion, wherein this first segment is bent outwardly through a predetermined arc in a direction away from the plane of symmetry (xx') and a second segment being provided past a second bending point located at the end of the outwardly bent abovementioned first segment, wherein this second segment is being bent inwardly through an equivalent predetermined arc in a direction of rapprochement of the plane of symmetry (xx'), whereby the sheet metal mobile portion with such zigzag extension is preferably being used in the connection of hollow profile members with chambers having a width within a range of 13-25 mm.

Additionally or alternatively, the above object is being achieved through use of a slide base portion that advantageously approaches the region of the walls in the chambers of the hollow profile members being connected wherein the indentation of the sheet metal mobile portion takes place, such effect being obtained with the employment of an elevated slide base portion that achieves rapprochement of the walls of the chambers intended to be indented by the sheet metal mobile portion, the same result being alternatively achieved by using the standard slide base portion in combination with an additional base raising member provided with legs adapted to raise the slide base portion at a desired level for the sheet metal mobile portion to effect an efficient indentation of the walls of chambers of the hollow profile members being connected, as well as through use of a joint with a slide base portion of the type of joints of the prior art that have a pair of side members fitting within the adjacent chambers of hollow profile members being brought in matching contact and used in association with a mechanical press assembly adapted to cut strips of the material of the walls of the chambers and embed those strips within recesses of the abovementioned side members of the joint to ensure stabilization thereof, wherein in the case of the joint of the invention the mechanical press assembly effecting cutting and embedding the strips to stabilize the joint are optional since an adequate stabilization thereof is already implemented with the indentation of the walls of the hollow profile members by the sharp edges of the sheet metal mobile portion.

BRIEF DESCRIPTION OF THE DRAWINGS

The invention will be made apparent to those skilled in the art by reference to the accompanying drawings, wherein.

DETAILED DESCRIPTION OF PREFERRED EMBODIMENTS

Figure 2A:
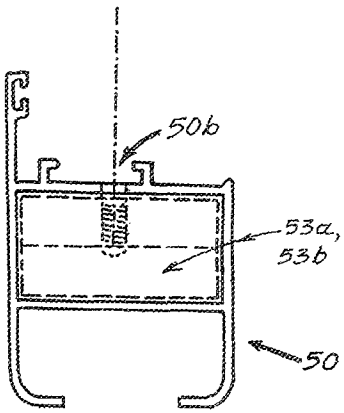
FIG. 2*a* shows a sectional view of an illustrative type of a hollow profile member adapted to receive the joint of the invention in a process of forming door/window profile frames.
Figure 2:
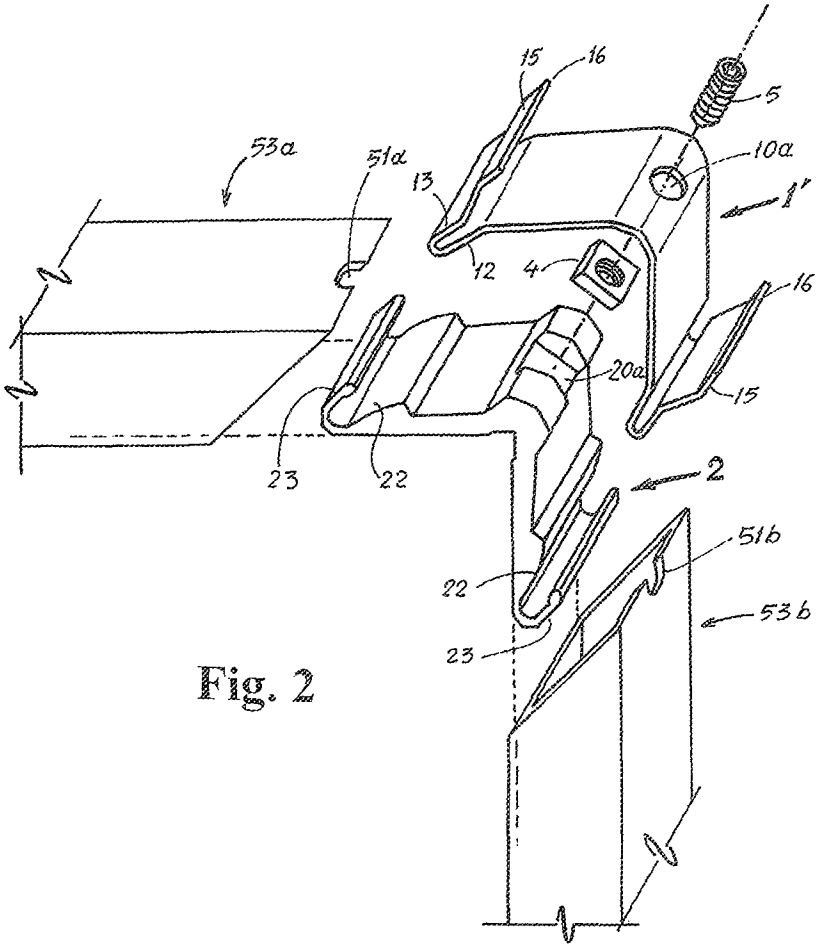
FIG. 2 shows a perspective view of the joint of the aforementioned second embodiment of the invention as used in the connection of a pair of hollow profile members that comprise chambers adapted to receive the joint when brought in matching contact.

The joint of the invention relates to the angular connection of aluminium profiles without being limited thereto, as it may also be used in the connection of profile members made from other soft metals or plastics. In most circumstances, the hollow profile members to be connected are perpendicularly oriented and their ends are cut at 45° so as to obtain an aesthetically optimal matching contact and connection thereof. The drawings depict connection of perpendicularly oriented hollow profile members, without however excluding the possibility of connection at any other obtuse or acute angular orientation. Thus the joint of the invention is particularly proposed for the connection of hollow profile members used in the construction of door and window frames, such frames being adapted to house a glass or a shutter panel or an insect repellent textile surface, etc. The joint of the invention may however also be used in the connection of hollow profile members adapted to form partition panels, racking structures, railings, frames for pictures and paintings, furniture assemblies and other varying applications as appropriate. With the inventive features of the present invention, the proposed joint is appropriately adjusted for the connection of hollow profile members irrespective of the size of the receiving chambers thereof. An illustrative embodiment of such a hollow profile member 50 is presented in FIG. 2*a*, wherein the hollow profile member 50 is provided with an open end section 50*a* adapted to receive a filler material (glass or shutter panel and the like), and an oppositely located end section 50*b* for the connection of the hollow profile member 50 onto the surrounding frame of the opening wherein the door or window is housed. A rectangular chamber 53*a* and 53*b* adapted to receive the joint of the invention is respectively provided in between end sections 50*a*, 50*b* in each one of a pair of hollow profile members 50 being brought for connection. For the sake of simplicity imaging of the entire hollow profile members 50 is omitted in the drawings, and it is only chambers 53*a* and 53*b* with the respective openings for the insertion of the joint that are illustrated in FIG. 2.

Figure 1B:
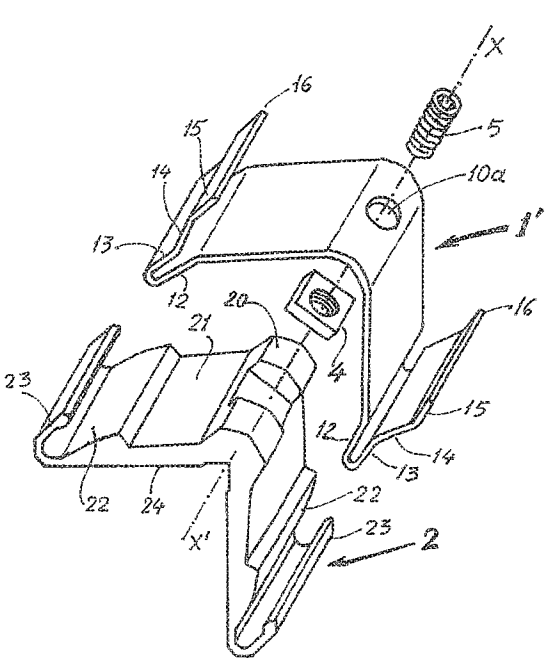
FIGS. 1*a* and 1*b* show an exploded perspective view of a first and a second embodiment of the joint of the invention with the individual items employed in the assembly thereof, namely of a base portion, a sheet metal mobile portion and a bolt and nut assembly.
Figure 1A:
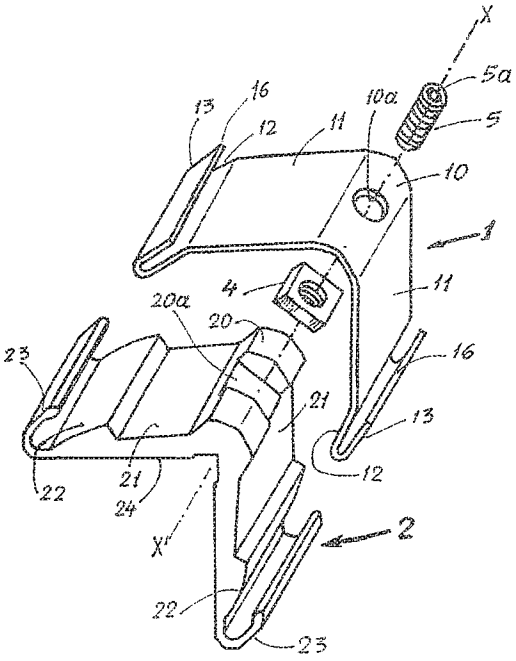

The joint of the present invention as shown in the exploded view of FIG. 1*a* and FIG. 1*b* comprises two elements with a configuration defining an outline that corresponds to the angle of abutment of the hollow profile members 50 being connected, and in particular it comprises a fixedly mounted base portion 2 and a sheet metal mobile portion 1, 1' the latter being mounted onto the base portion 2 and having a configuration that is generally similar to the configuration of the underlying surface of the base portion 2.

The sheet metal mobile portion 1, comprises side parts symmetrically extending on either side of a base 10, wherein each one of these side parts comprises a first planar side surface 11 extending into an inwardly bent second planar side surface 12 that eventually extends to an upwardly bent terminal side surface 13, such upwardly bent terminal side surfaces 13 having sharpened edges being adapted to indent the walls in the chambers 53*a*, 53*b* of the hollow profile members 50 being connected. The upwardly bent terminal side surfaces 13 have a straight line configuration in a first embodiment of a sheet metal mobile portion 1 shown in FIG. 1*a*, whereas they are provided with a zigzag extension 14, 15 downstream of their straight line configuration in a second embodiment of a sheet metal mobile portion 1' shown in FIG. 1*b*.

Figure 3B:
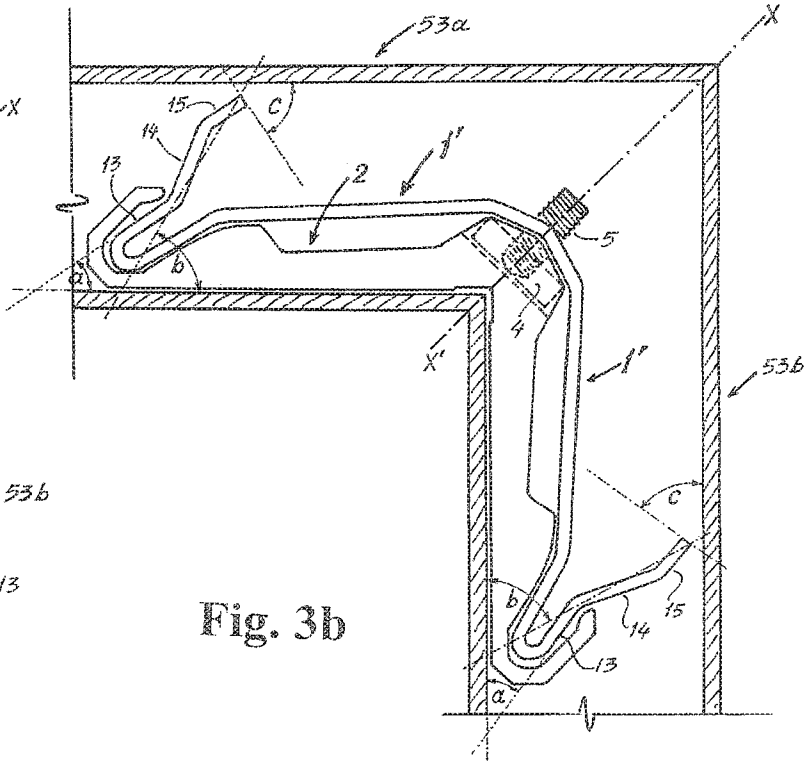
FIGS. 3*a*, 3*b* respectively show a sectional view of the joint of the aforementioned first and second embodiment of the invention within the receiving chambers of a pair of hollow profile members in a position prior to the initiation of the process of angular connection thereof.
Figure 3A:
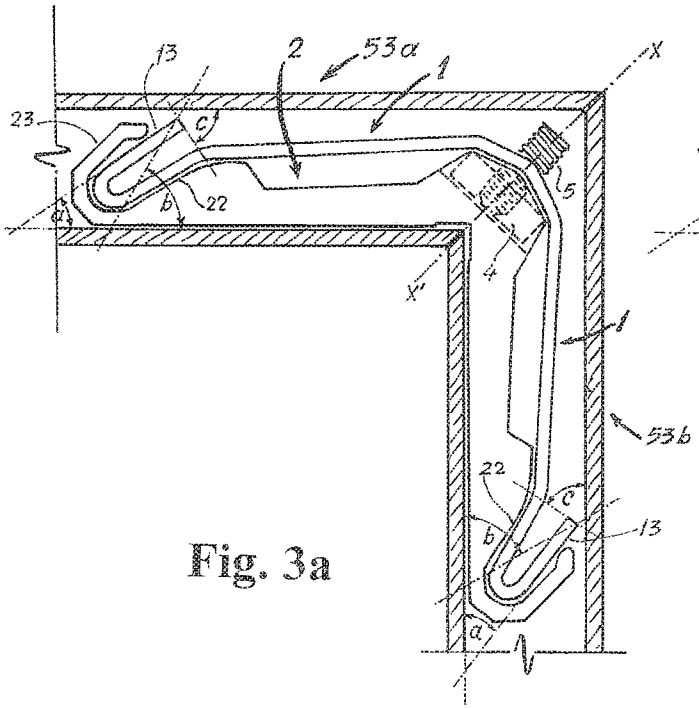
Figure 4B:
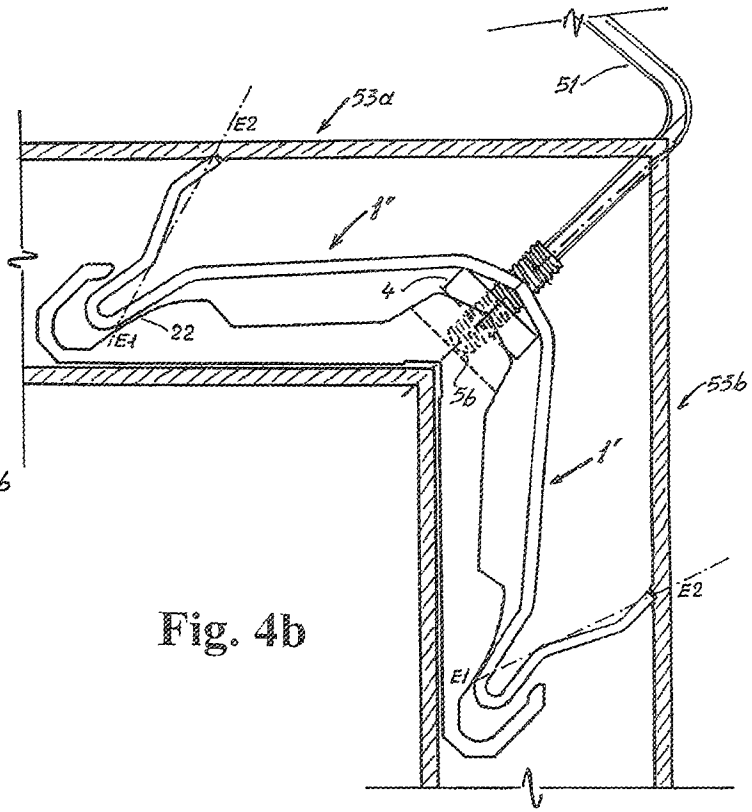
FIGS. 4*a*, 4*b* respectively show a sectional view of the joint of the aforementioned first and second embodiment of the invention within the receiving chambers of a pair of hollow profile members in a position following completion of the process of angular connection thereof through a screwing operation of the key illustrated therein.
Figure 4A:
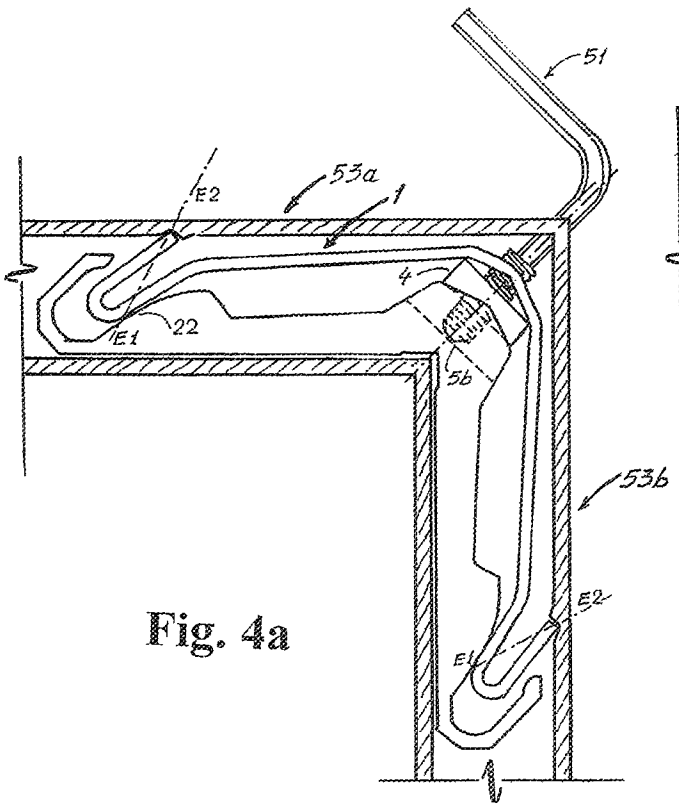

A bolt 5 is employed in providing interconnection of the elements of the joint of the invention, the bolt 5 having a bore and a threading such that it may be screwed using an Allen key 51, which as shown in FIGS. 4*a*, 4*b* is inserted within a cavity 5*a* (FIG. 1*a*) of the bolt 5 and drives the latter to pass through a through hole 10*a* provided medially along the upper base 10 of the sheet metal mobile portion 1, 1" and screwed into a nut 4 that is mounted within a cavity 20*a* provided medially along an upper base 20 of the base portion 2, wherein screwing of bolt 5 is terminated as the pointed end 5*b* thereof contacts the base portion 2 as shown in FIGS. 3*a*, 3*b* or is screwed further within a threaded opening of the base portion underlying nut 4, as shown in FIGS. 4*a* and 4*b*. It is herein noted that, in an assembled mode of the joint of the invention, both the fixedly mounted base portion 2 and the sheet metal mobile portion 1, 1', as well as the bolt 5 and nut 4 have a common plane of symmetry xx' that passes through the plane of matching contact of the previously cut edges of chambers 53*a*, 53*b* of the hollow profile members 50 being connected.

With a scope of achieving an optimal indentation effect of the walls of chambers 53*a*, 53*b* of the hollow profile members 50 being connected and taking into account that these chambers may have a variable width, the sheet metal mobile portion 1 with the linearly configured upwardly bent terminal side surfaces 13 of the first embodiment is preferably used with chambers 53*a*, 53*b* having a width within a range of up to about 10-12 mm and the sheet metal mobile portion 1' with the zigzag extension 14, 15 of the second embodiment is preferably used with chambers 53*a*, 53*b* having a larger width that reaches up to about 25 mm, thereby advantageously displacing the line of indentation of the walls of chambers 53*a*, 53*b* by the sharpened edge of the upwardly bent parts of the sheet metal mobile portion in a direction away from the plane of symmetry xx' at a distance increased in comparison with the distance of elongate upwardly bent terminal side surfaces 13 with a straight line configuration. The zigzag extension 14, 15 of the aforementioned second embodiment serves to provide an optimally effective indentation effect in hollow profile members comprising chambers 53*a*, 53*b* having a larger width that reaches up to about 25 mm.

Alternatively or in addition to selective use of either the sheet metal mobile portion 1 or 1' in order to achieve an optimal line of impact and indentation onto the walls of chambers 53*a*, 53*b*, varying embodiments of the base portion 2, 2', 2" might be employed, such alternative embodiments being described hereinafter.

As mentioned hereinabove the sheet metal mobile portion 1, 1' comprises an upper base 10 that is being disposed onto an underlying upper base 20 of the base portion 2. In accordance with a preferred embodiment of the invention, the upper base 10 and the upper base 20 are configured as obtuse angles with the vertex of these angles passing through the plane of symmetry xx' of the joint of the invention.

According to a first embodiment of the invention the sheet metal mobile portion 1, 1' is provided with side parts symmetrically arranged on either side of the base 10 and each one of these side parts comprises a first planar side surface 11 extending into an inwardly bent second planar side surface 12, wherein the abovementioned first planar side surface 11 has a length generally equivalent to the length of an underlying corresponding first section 21 and the inwardly bent planar side surface 12 abuts onto a correspondingly sized upwardly sloped section 22 of base portion 2 and has a length generally equivalent to the length of this underlying corresponding upwardly sloped section 22 of the slide base portion 2, 2', 2", such upwardly sloped sections 22 being adapted to provide, when bolt 5 is being tightened, a sliding platform for the inwardly bent flat surfaces 12, this sliding leading to the sheet metal mobile portion 1, 1' being lifted and thereby being brought at a position enabling indentation of the walls of the chambers 53*a*, 53*b* of the hollow profile members being connected. The inwardly bent planar side surfaces 12 of the sheet metal mobile portion 1, 1' are bent upwardly through an arc of 180°, thereby forming the upwardly bent terminal side surfaces 13, which are oriented in a direction parallel to the plane of symmetry xx'. Accordingly, the aforementioned upwardly sloped sections 22 of base portion 2 are also bent upwardly through an arc of 180°, thereby forming terminal side surfaces 23, which are oriented in a direction parallel to the plane of symmetry xx', such terminal side surfaces 23 in combination with the upwardly sloped sections 22 thereby defining sockets 22-23 adapted to receive the correspondingly inwardly bent planar side surfaces 12 followed by the upwardly bent terminal side surfaces 13 of the sheet metal mobile portion 1, 1'.

According to the second embodiment of the invention wherein the sheet metal mobile portion 1' is employed to serve connecting of larger profile chambers 53*a*, 53*b* having a width within a range of 13-25 mm, the upwardly bent terminal side surfaces 13 extend into zigzag extensions 14-15, such zigzag extensions 14-15 being adapted to shift the line of impact and indentation of the sheet metal mobile portion 1' in a direction away from the plane of symmetry xx' of the joint of the invention. In the case of the sheet metal mobile portion the intended zigzag extension 14-15 is implemented with a pair of bending points along the upwardly bent parts of the mobile portion 1', a first bending point being provided at the end of the aforementioned upwardly extending terminal side surfaces 23 of base portion 2, whilst a first portion 14 of the zigzag extension 14-15 is bent outwardly through a predetermined arc in a direction away from the plane of symmetry xx' and a second bending point being provided at the end of the outwardly bent first portion 14, whereby a second portion 15 of the zigzag extension 14, 15 is being bent inwardly through the same aforementioned predetermined arc in a direction of rapprochement of the plane of symmetry xx'. It is therefore clear that in this second embodiment of the invention the upwardly bent side of the sheet metal mobile portion 1' consists of three successive linear segments, i.e. a first linear segment 13 that is encased within the socket formed in between the upwardly extending terminal side surface 23 and the upwardly sloped section 22 of base portion 2, a second linear segment 14 extending between the aforementioned first and second bending points and a third linear segment 15 downstream of the second bending point, the latter inwardly bent linear segment 15 achieving displacement of the line of impact onto the wall of the chamber of the hollow profile member 50 in a position that ensures an optimal indentation thereof.

It is a requirement of the joint of the invention to provide the sheet metal mobile portion 1, 1' made from a relatively hard metal, such as steel or other, so that it may have the capacity of indentation of the walls of the profile members 50 being connected, the latter being made from a relatively softer material, such as aluminium or plastic or other.

Figures 9A, 9B, 9C:
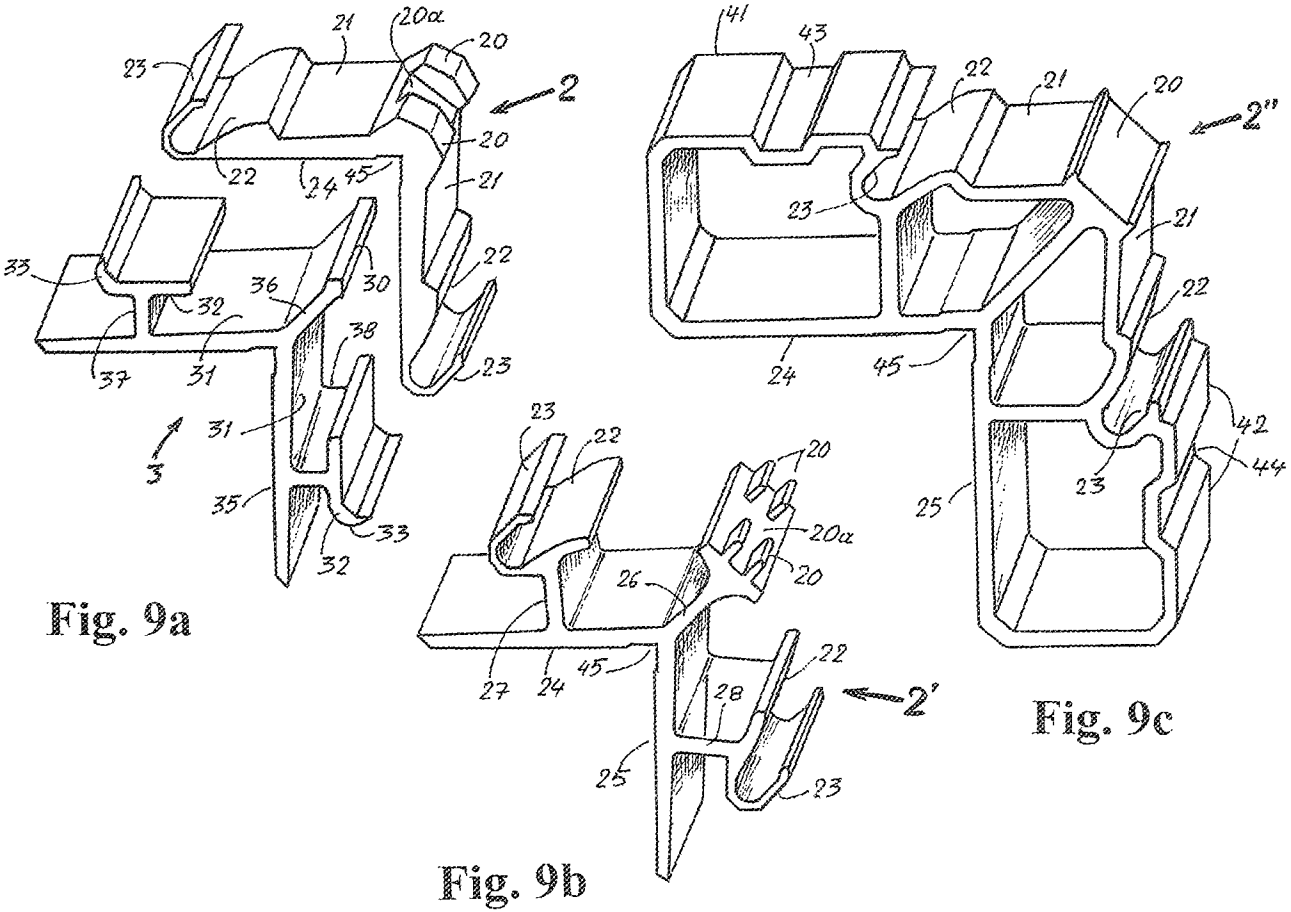
FIGS. 9*a*-9*c* show varying embodiments of the base portion onto which is being mounted the sheet metal portion of the joint of the invention.

The fixedly mounted slide base portion 2 as shown in FIG. 1*a*, 1*b* and 9*a* is an angular item with a pair of side parts having flat inner surfaces 24, 25 that abut the walls of the hollow profile members being connected and forming an angle that corresponds to the angle formed between the hollow profile members being brought in matching contact, this angle being an angle of 90° in the case illustrated in the drawings. In this way, the abovementioned flat inner surfaces 24, 25 of the side parts of base portion 2 can slide in abutment with the walls of the respective chambers 53*a*, 53*b* of the hollow profile members being connected, albeit in accordance with a preferred embodiment of the invention, with a scope of averting any inconvenience in such sliding abutment that may be caused by possible deformations due to cutting deficiencies at the vertex of this angle, a slight indentation 45 is provided at the vertex of the angle formed by the flat inner surfaces 24, 25 so as to avert any inconveniency as these flat inner surfaces 24, 25 abut on the walls of the chambers 53*a*, 53*b* of the hollow profile members being connected. The exterior of the base portion 2 that is adapted to receive the sheet metal mobile portion 1, 1' comprises an upper base 20 that is preferably configured as an obtuse angle, this obtuse angle being the same as the obtuse angle of the upper base 10 of the sheet metal mobile portion 1, that is mounted thereupon. A cavity 20*a* is provided preferably medially along the longitudinally extending upper base 20 and a nut 4 is inserted and firmly supported within such cavity 20*a*. Exterior side parts are provided at the reverse side of the flat inner surfaces 24, 25, symmetrically on either side of the upper base 20, each one of these side parts comprising a first section 21 extending into a second upwardly sloped terminal side surface 22 whereupon abuts the correspondingly sized inwardly bent flat surfaces 12 of the mobile portion 1, 1', wherein these flat surfaces 12 smoothly slide onto the sloped platforms 22 leading to an upwardly pushing force being exerted onto the mobile portion 1, 1 as the bolt 5 is being screwed. Following the sloped platform 22, the base portion 2 is bent upwardly through rotation by 180° and an upwardly bent side 23 is formed, such upwardly bent sides 23 being oriented parallel to the plane of symmetry xx'. This configuration of the upwardly bent sides 23 in combination with the sloped platforms 22 defines on either side of base portion 2 sockets being adapted to receive the correspondingly bent flat surfaces 12 followed by the terminal upwardly bent parts 13 of the sheet metal mobile portion 1, 1 as illustratively shown in the sectional views of FIGS. 3*a*, 3*b*, and of FIGS. 4*a*, 4*b* respectively presenting the joint of the aforementioned first and second embodiment of the invention within the receiving chambers of a pair of hollow profile members in a position prior to the initiation of the process of angular connection thereof (FIGS. 3*a*, 3*b*) and in a position following completion of the process of angular connection thereof through a screwing operation of bolt 5 with the Allen key 51 illustrated therein (FIGS. 4*a*, 4*b*).

With the configuration described hereinabove a certain desirable necessary length of contact of the firmly mounted base portion 2 with the overlying sheet metal mobile portion 1, 1' is ensured such length of contact providing an appropriate slide guide for the mobile portion 1, 1'.

The aforementioned upwardly bent terminal parts 13 of the sheet metal mobile portion 1 or 13-14-15 of the sheet metal mobile portion 1 respectively have a length such that, as shown in FIGS. 3*a* and 3*b*, the joint of the invention may be inserted within the adjacent chambers 53*a* and 53*b* of the hollow profile members 50 being brought in matching contact without its insertion being impeded by impact of the ends thereof onto the walls of chambers 53*a*, 53*b*. Thereafter, as tightening of the central bolt 5 and screwing thereof into the nut 4 is initiated, the pressure being exerted by the sharp head 5*b* of bolt 5 onto the cavity 20*a* of the upper base 20 of the base portion 2 maintains base portion 2 firmly mounted within the matching chambers 53*a*, 53*b* and causes the sheet metal mobile portion 1, to move upwardly through sliding of the flat surfaces 12 thereof along the sloped platforms 22 of the base portion 2 until the sharpened edges 16 of the sheet metal mobile portion 1, indent the walls of chambers 53*a*, 53*b* of the hollow profile members 50 being connected.

As characteristically shown in the enlarged detail view of FIGS. 4*a* and 4*b*, the indentation of the sharpened edges 16 of the sheet metal mobile portion 1, 1' in the walls of chambers 53*a*, 53*b* results in the perfect convergence along the plane of symmetry xx' of the hollow profile members 50 being connected. This mode of the walls of chambers 53*a*, 53*b* being indented by the sharpened edges 16 of the sheet metal mobile portion 1, 1 results to the latter being resiliently stressed, uniformly on both sides of the respective chambers 53*a*, 53*b*, and this ensures retention of a perfectly stable connection of profiles 50 even if an unintentional loosening of the tightening of the bolt 5 might occur.

As illustrated in FIG. 2, a single hole is required for the passage of the bolt 5 being driven through introduction of the Allen key 51 in the cavity 5*a* thereof in the process of use of the joint of the invention and this is an important advantage over the multiple precisely opened holes which are required when joints of the prior art are used as described hereinabove. This single hole is conveniently and handily marked and opened to comprise one half hole 51*a* medially along the edge of chamber 53*a* and another half hole 51*b* medially along the edge of chamber 53*b*, so that when the pair of hollow profile members 50 are brought in matching contact the single hole 51*a*-51*b* is being defined for the passage of the bolt 5 of the joint of the invention.

FIGS. 9*a*, 9*b*, 9*c* present varying embodiments of the base portion of the joint, which may be alternatively used to achieve the intended rapprochement of the sharpened edges 16 of the sheet metal mobile portion 1 or 1' in the walls of chambers 53*a*, 53*b* of the hollow profiles 50 being connected and implement the intended indentation therein. Thus, whilst FIG. 9*a* includes the base portion 2 already described and illustrated in FIGS. 1*a*, 1*b* and 2, FIG. 9*b* presents a base portion 2' that comprises the necessary operating features of an upper base 20 whereupon sits the correspondingly configured upper base 10 of the sheet metal mobile portion 1, 1' and of a medially disposed cavity 20*a* adapted to receive the nut 4 and of the side parts with the sockets 22, 23 adapted to nest the folded surfaces 12, 13 of the sheet metal mobile portion 1, 1', as well as of the outer planar surfaces 24, 25 adapted to abut the walls of the chambers 53*a*, 53*b* of the profiles 50 being connected. However the base portion 2' of FIG. 9*b* is characterized in that it comprises a first leg member 26 that extends in the direction of the plane of symmetry xx' beyond the vertex of the angle formed at the intersection of the side surfaces 24, 25 and it further comprises a second and a third leg member 27 and 28 respectively, symmetrically extending on either side of the first leg member 26, such leg members 27, 28 extending perpendicularly from the flat surfaces 24, 25 respectively, whereby leg members 26, 27, 28 advantageously effect raising of the aforementioned operational features of the upper base 20 and of the socket configurations on either side thereof at a higher level, thereby rendering such a base portion 2' suitable for use in combination with a sheet metal mobile portion 1 to serve connection of larger hollow profile members 50 having chambers 53*a*, 53*b* with a width within the range of 13-25 mm.

Alternatively or in addition to the raised slide base portion 2' described hereinabove that is appropriately applicable in the connection of hollow profile members 50 with chambers 53*a*, 53*b* of a larger width, the standard slide base portion 2 might be employed to serve connection of such profile members by means of lifting it at the desired height through using an additional base raising member 3, which, as illustrated in FIG. 9*a*, is an element with an angular configuration identical to that of the slide base portion 2 with a pair of intersecting sides with outer planar surfaces 34, 35 abutting the walls of the chambers 53*a*, 53*b* of the hollow profile members 50 being connected and further comprising a leg member 36 extending along the plane of symmetry xx' from the plane of contact of the aforementioned outer planar surfaces 34, 35, such leg member 36 having a top edge 30 being configured in the shape of an oblique angle adapted to fit within the slight indentation 45 provided along the plane of intersection of the outer planar surfaces 24, 25 of the base 2 or 2'. Leg members 37, 38 are provided symmetrically on either side of leg member 36, wherein leg members 37, 38 extend perpendicularly upwardly from the surfaces 34, 35 respectively and their ends are configured in the shape of a platform 32 with a curvilinear lateral edge 33, which is adapted to provide mounting thereupon of the socket 22-23 provided at the sides of the base portion 2 and being adapted to nest the correspondingly bent terminal side parts 12, 13 of the sheet metal mobile portion 1, 1'. A similarly configured additional base raising member 3 may be employed to provide raising of the slide base portion 2', however without the platforms 32 with the curvilinear lateral edge 33 at the ends of the aforementioned leg members 37, 38, but with these leg members 37, 38 appropriately abutting the outer planar surfaces 24, 25 of the slide base portion 2'.

FIG. 9*c* shows a further embodiment of a base portion 2" of the joint of the invention, which uses a slide base portion of the type used in conjunction with a mechanical press apparatus, wherein the abovementioned base portion 2" comprises a flat base 20 centrally located at the region of the plane of convergence of the hollow profile members being connected, i.e. at the region of the plane of symmetry xx', and side parts symmetrically extending on either side of this flat base 20, such side parts extending at the socket configurations 22-23, these sockets 22-23 being adapted for receiving the accordingly bent terminal side surfaces 12-13 of the sheet metal portion 1 or 1', and wherein, downstream those sockets 22-23, this base portion 2" extends at side members 41, 42 appropriately sized so as to fit into the chambers 53*a* and 53*b* respectively of the hollow profile members being connected. Recesses 43 and 44 are respectively provided transversally along the surfaces of side members 41, 42, such recesses 43, 44 being adapted to receive strips being cut through cutting blades being applied exteriorly of the hollow profile members 50 by the mechanical press assembly being employed, such strips being embedded within the recesses 43, 44 thereby optionally offering stabilization of side members 41, 42 of the joint in addition to the indentation of the edges of the sheet metal mobile portion 1, into the walls of chambers 53*a*, 53*b*. Further to the above, it is still possible to optionally use an adhesive to enhance stabilization of side members 41, 42 within the chambers 53*a*, 53*b* of the hollow profile members being connected. Whilst use of the process of embedding the above strips within the recesses 43, 44 in the slide base portion of the invention is to be considered merely supplementary and optional, it is a necessary requirement in joints of this type used in the prior art.

Figure 11B:
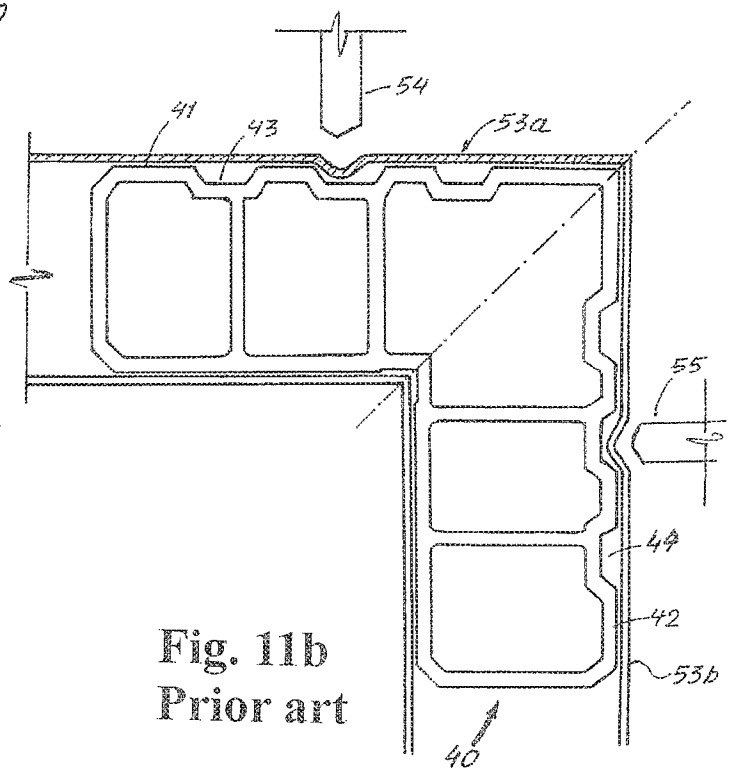
Fig. 11b Prior art
FIGS. 11*a* and 11*b* respectively show a joint of the prior art and its use in the connection of a pair of matching hollow profile members that requires employment of a mechanical press adapted to effect cutting of strips in the walls of the hollow profile members and insertion thereof in appropriately configured recesses of the joint.
Figure 11A:
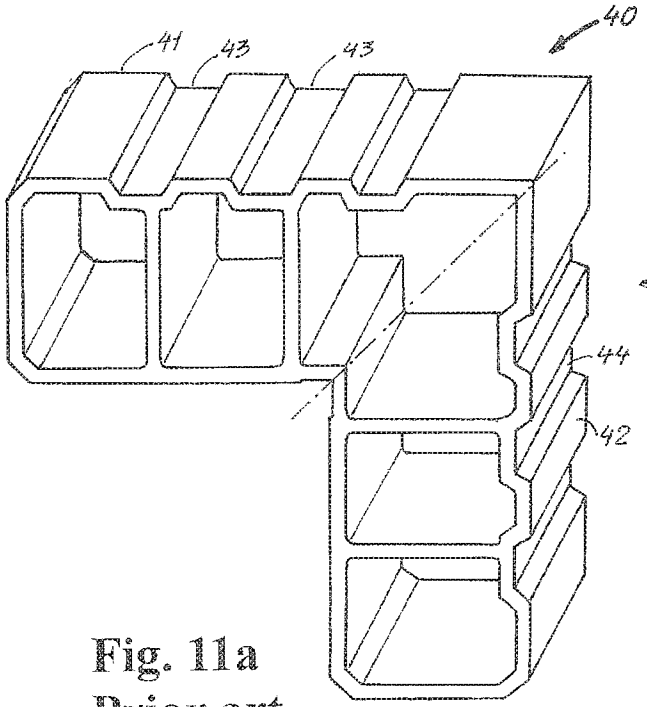
Fig. 11a Prior art

FIG. 11*a* shows a joint 40 of hollow profile members of the prior art comprising orthogonally oriented side members 41, 42 with appropriately arranged recesses 43, 44 respectively, such side members 41, 42 being respectively inserted within the chambers 53*a*, 53*b* of the profile members and such joint 40 being employed in association with a mechanical press apparatus being provided with cutting blades 54, 55, such cutting blades 54, 55 being disposed proximate to the recesses 43, 44 of side members 41, 42 respectively (FIG. 11*b*), whereby they are adapted to cut strips of material of the walls of chambers 53*a*, 53*b* respectively and push such strips within the recesses 43, 44, thereby stabilizing joint 40 and effecting a firm connection of the orthogonally abutting hollow profile members 50. Stabilization of the connection may be further enhanced through use of an adhesive matter for previously gluing the side members 41, 42 within the chambers 53*a*, 53*b*.

Figure 10C:
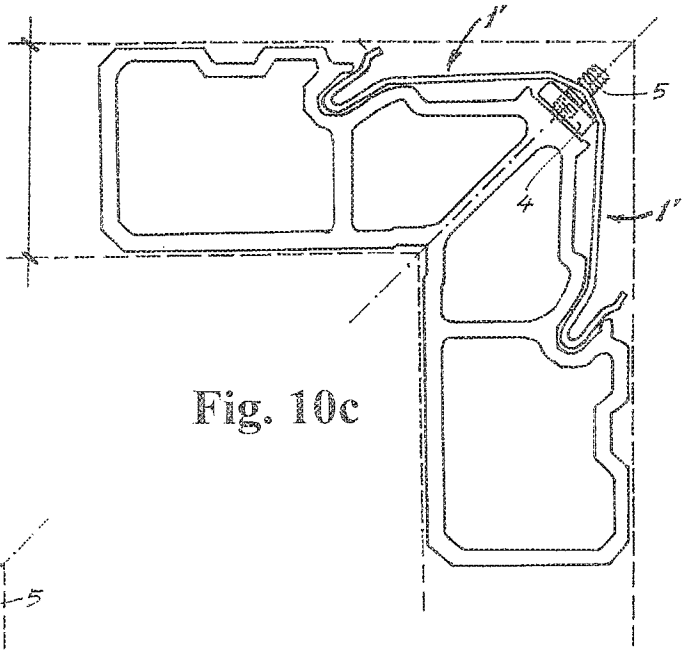
FIGS. 10*a*-10*c* respectively show application of the varying embodiments of the base portion of FIGS. 9*a*-9*c* in the angular connection of a pair of hollow profile members.
Figure 10A:
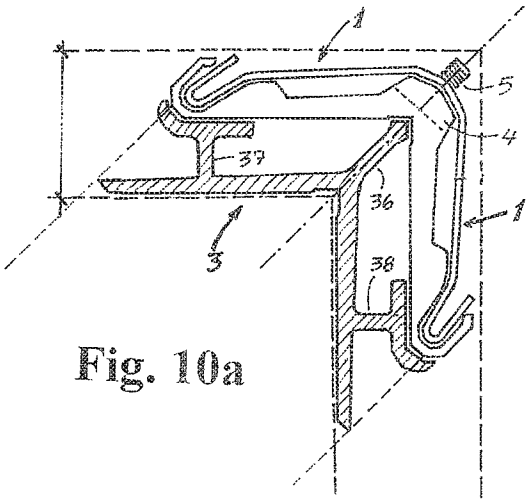
Figure 10B:
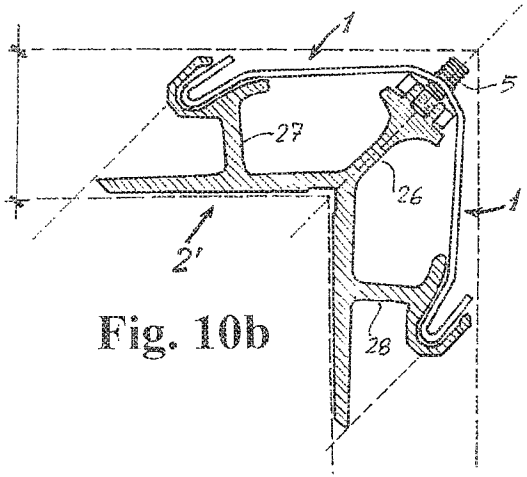

In FIGS. 10*a*-10*c* are shown in correspondence with the varying embodiments of the firmly mounted base portion 2, 2', 2" depicted in FIGS. 9*a*-9*c* alternative embodiments of the joint of the invention employing a sheet metal mobile member 1 (FIGS. 10*a*, 10*b*) and a sheet metal mobile member 1' (FIG. 10*c*).

It is therefore made evident that the angular connection of varying sizes of hollow profile members necessitates using an appropriate base portion 2 or 2' or 2" in combination with an appropriate sheet metal mobile portion 1 or 1' in order to implement an optimally reliable angular connection of the hollow profile members with the joint of the invention satisfying certain predetermined geometrical parameters as enlisted hereinbelow:

The angle (a) formed by each one of the upwardly bent terminal side surfaces 13 of the sheet metal mobile portion 1, 1 with a corresponding one of the outer planar surfaces 24, 25 of the base portion 2, 2', 2" with a wall of each one of the chambers 53*a*, 53*b* of the hollow profile members 50 whereupon the base portion 2, 2', 2" is mounted has a minimum value of 45° (FIGS. 3*a*, 3*b*).

Figure 5A:
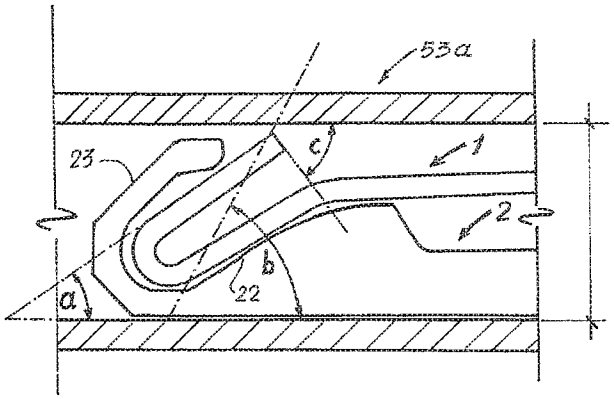
FIGS. 5*a* and 5*b* respectively show a detail of a portion of the joint of the aforementioned first and second embodiment of the invention at the region of indentation of the sheet metal mobile portion into the walls of a hollow profile member, wherein the orientation of the sheet metal mobile portion conforms with a set of angular parameters with a scope of effecting an optimal indentation effect.
Figure 5B:
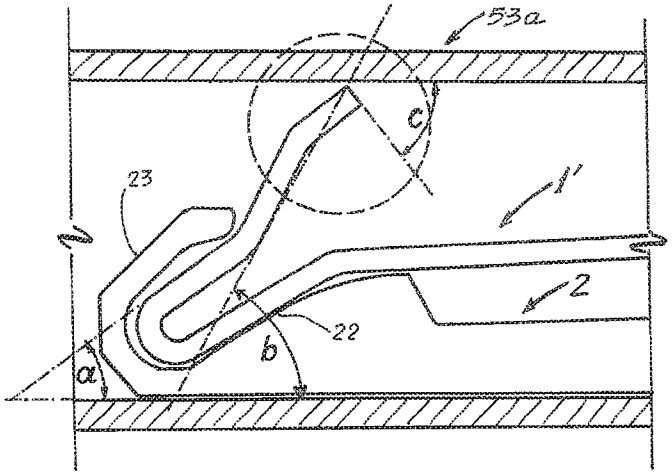

The angle (b) formed by the wall of the chambers 53*a*, 53*b* of the profiles 50 being connected onto which is mounted the base portion 2, 2', 2" with a straight line passing through a terminal point E1 of contact of the inwardly bent side surface 12 of the sheet metal mobile portion 1 or 1' with the section surface 22 of base portion 2, 2', 2" prior to the upward bending thereof into the upwardly bent part 13 and through a point E2 of impact of the upwardly bent part 13 or 13-14-15 of the sheet metal mobile portion 1 or 1' respectively onto the opposing wall of the chambers 53*a*, 53*b* of the profiles being connected must have a value of the order of 60° (FIGS. 4*a*, 4*b*), and The angle (c) formed by a wall of the chambers 53*a*, 53*b* of the hollow profile members 50 being connected, which is being indented by the sheet metal mobile portion 1 or 1 with the line that transversally crosses the terminal sharp edge 16 of the sheet metal mobile portion 1 or should have a value within a preferred range of 45°-55°, and preferably a value of the order of 45° (FIGS. 5*a*, 5*b*).

Figure 6A:
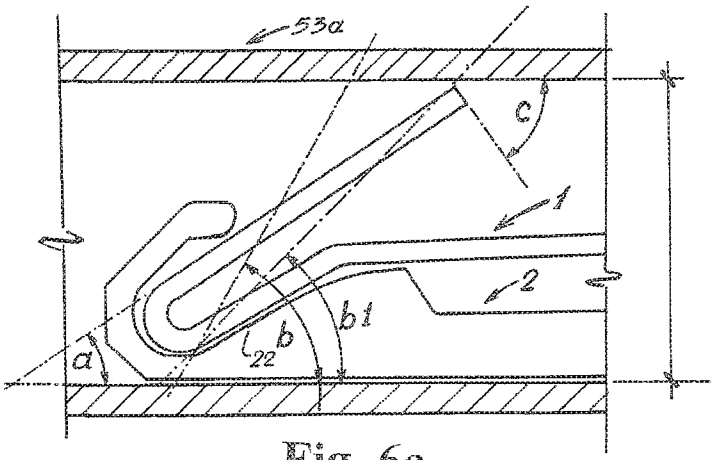
FIGS. 6*a* and 6*b* respectively show a detail of a portion of the joint of the aforementioned first embodiment of the invention at the region of indentation of the sheet metal mobile portion into the walls of a hollow profile member, wherein the orientation of the sheet metal mobile portion fails to conform with the angular parameters that provide an optimal indentation effect.
Figure 6B:
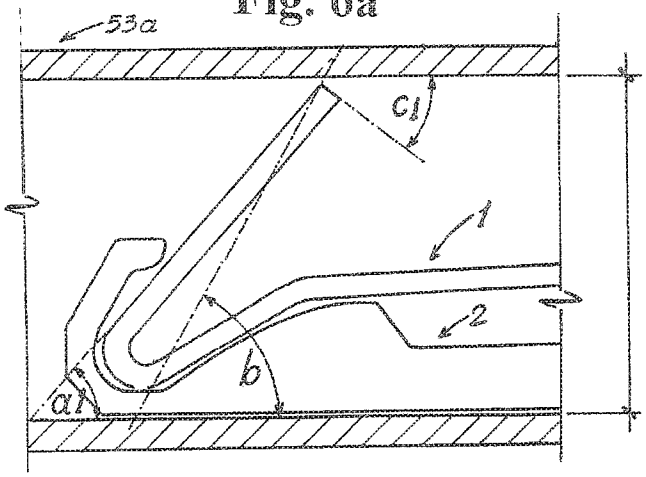

FIGS. 5*a* and 5*b* respectively present a detail of the angular joint of the aforementioned first and second embodiment of the invention wherein use is made of the sheet metal mobile portion 1 and 1' adapted to indent a wall of the chamber 53*a* of hollow profile members having a width within a range of 10-12 mm and within a range of 13-25 mm respectively. The detail being depicted in FIGS. 5*a*, 5*b* is focused on the region of indentation by the sheet metal mobile portion of the wall of the chamber 53*a* and it is apparent that a proper orientation of the sheet metal mobile portion has been accomplished, this orientation conforming with the abovementioned predetermined geometrical parameters. Contrary to the proper orientation of the sheet metal mobile portion shown in FIGS. 5*a*, 5*b*, FIGS. 6*a* and 6*b* show a detail of the joint of the aforementioned first embodiment of the invention as applied within a chamber 53*a* of a hollow profile member 50 having a width of the order of 25 mm, wherein it is evident that the elongate upwardly extending part of the sheet metal mobile portion 1 is incorrectly oriented and fails to observe the aforementioned predetermined geometrical parameters. In particular FIG. 6*a* apparently shows violation of the limits of the above predetermined geometry with the sheet metal mobile portion impacting onto the wall of chamber 53*a* at a point along a line determined by an angle (b1), which is drastically reduced in comparison with the desired predetermined parameter of angle (b) that is of the order of 60° as defined hereinabove. FIG. 6*b* also apparently shows violation of the limits of the above predetermined geometry with the angle (a1) having a value substantially higher from the desired predetermined value of angle (a) that is of the order of 45°.

Figures 8A, 8B, 8C:
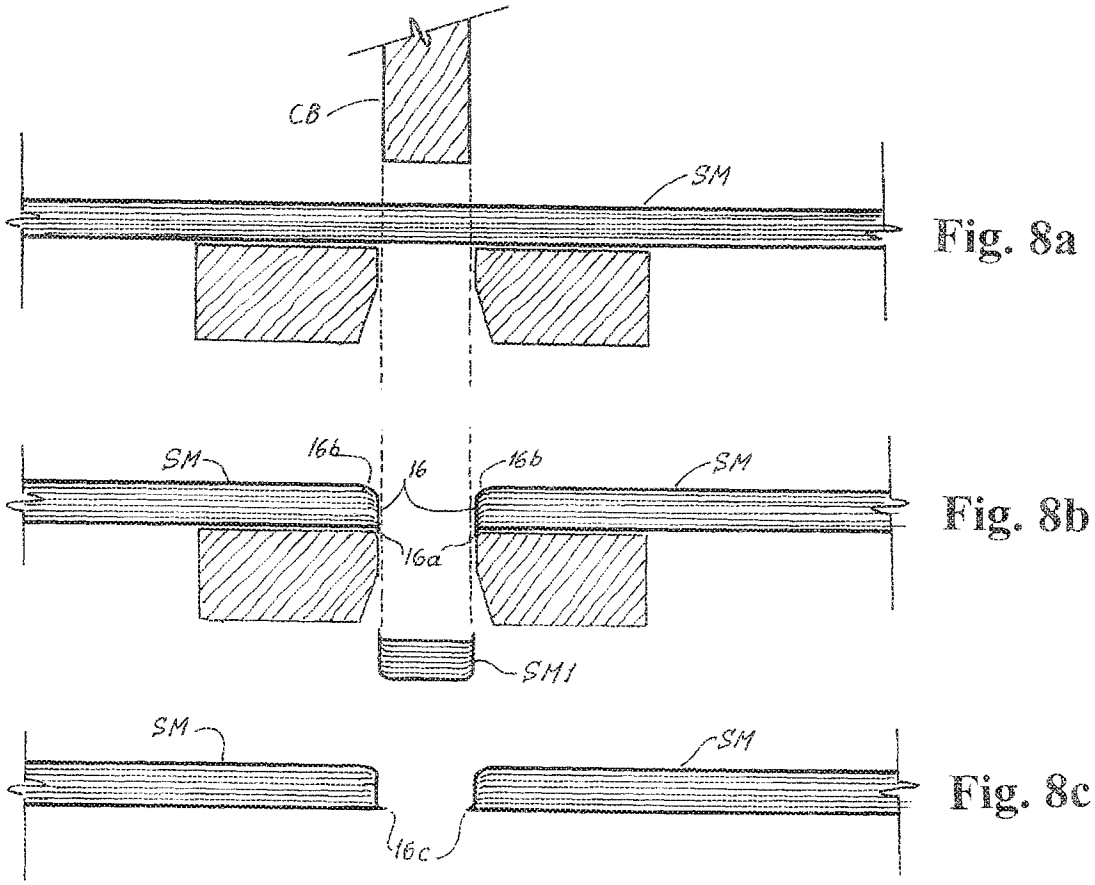
FIGS. 8*a*-8*b* show successive cutting steps in the manufacturing of the sheet metal portion of the joint of the invention.
FIG. 8*c* shows a step of forming the terminal end of the sheet metal portion of the joint of the invention to provide an appropriately sharpened configuration thereof.

As mentioned in the introductory part hereinabove, an object of the present invention is to carry out an appropriate forming of the aberrant terminal edge of the sheet metal portion of the joint of the invention after cutting thereof with a scope of aligning it in the longitudinal direction of the planar sheet metal and of creating a sharpened edge thereof as appropriate for impacting and indenting the wall of the chambers of the hollow profile members being connected. FIGS. 8*a*-8*c* sequentially show the phases of the rapprochement of the sheet metal (SM) that is shown in an enlarged view at a cutting die prior to the action of the cutting blade (CB) thereof (FIG. 8*a*) and of the cutting of a portion (SM1) thereof (FIG. 8*b*) whereby an aberrant sharp edge 16*a* is being created at one side of a terminal edge 16 of the sheet metal being cut and a curvilinear recess 16*b* is being created at the other side thereof. FIG. 8*c* eventually shows a step in the manufacturing of the sheet metal portion of the joint of the invention that comprises forming of the terminal edge thereof to provide an appropriately sharpened edge configuration 16*c*.

Figure 7A:
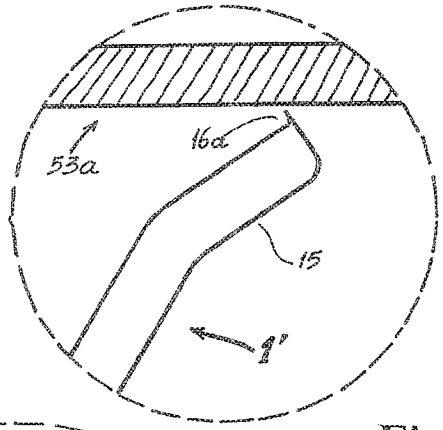
FIGS. 7*a*, 7*b* show a detail of the contact of the sheet metal mobile portion of the joint of the second embodiment of the invention with a wall within the chamber of the hollow profile member, wherein the sheet metal mobile portion is respectively provided with an inappropriately and an appropriately sharpened terminal end.
Figure 7B:
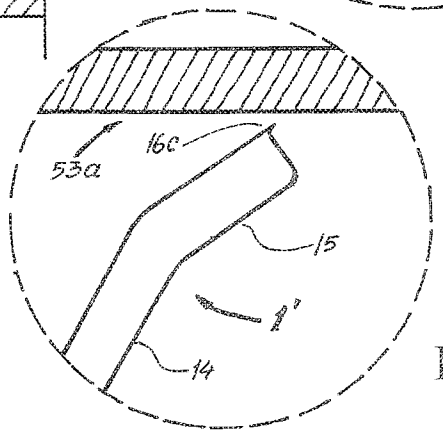

As illustrated in FIGS. 7*a*, 7*b* which show a detail of the joint of the second embodiment of the invention at the point wherein the sheet metal mobile portion 1 impacts onto the wall of the chamber 53*a* of a hollow profile member and wherein the aberrant sharpened edge 16*a* produced during cutting of the sheet metal as shown in FIG. 8*b*, is, as illustrated in FIG. 7*a* incompatibly and undesirably oriented, thereby failing to achieve an optimum impact of the sheet metal mobile portion 1 or 1' onto the wall of chamber 53*a* of the profile 50 and to achieve an appropriate indentation thereof. In the contrary, a desired and appropriate for achieving optimal impact of the sheet metal portion 1 or 1' onto the wall of chamber 53*a* of the profile 50 sharpened edge configurations 16*c* of the sheet metal portion is being illustrated in FIG. 7*b* as derived from the alignment forming process presented in FIG. 8*c* hereinabove.

It is herein noted that the aligned configuration of the terminal edge of the sheet metal portion is not visible to a naked eye, but it is observed as a change in the texture of the surface of the sheet metal portion 1 or 1'.

The use of the joint of the invention specifies an innovative method of angular connection of a pair of abutting hollow profile members made from aluminium and related materials, the method comprising the following steps:

a. Cutting the edges of the hollow profile members 50 adapted to being angularly connected, such cutting being made at an angle having half the value of the intended angle of connection of hollow profile members 50, e.g. for an intended connection of hollow profile members at an angle of 90°, profile edges are cut at an angle of 45°, and drilling of a hole 51*a,b* allowing driving of the key 51 used for tightening the bolt 5, wherein one half 51*a* of hole 51*a,b* is located centrally along the edge of chamber 53*a* of a first one of the hollow profile members 50 being connected and another half 51*b* of hole 51*a,b* is located centrally along the edge of chamber 53*b* of a second one of the hollow profile members 50 being connected.

b. Selecting a base portion 2 or 2' of the joint of the invention with or without an additional base raising member 3 appropriately corresponding to the width of the chambers (53*a*, 53*b*) of the hollow profile members being connected or of a base portion 2" in combination with a sheet metal portion 1 or 1' and performing assembly of the joint through driving of the bolt 5 through the through hole 10*a* of the sheet metal portion 1 or 1' and screwing the same into the nut 4 mounted onto the base portion.

c. Introduction of a first half of the assembled joint into the chamber 53*a* of a first one of the hollow profile members 50 being connected.

d. Bringing chamber 53*b* of a second one of the hollow profile members 50 being connected into matching contact with chamber 53*a* of the first one of the hollow profile members 50 being connected and inserting the second half of the assembled joint that projects outwardly from chamber 53*a* into the chamber 53*b*, whereby hole 51*a,b* is being formed through the abutment of matching half holes 51*a* and 51*b*.

e. Inserting the key 51 through the hole 51*a,b* and rotation thereof for screwing bolt 5 into the nut 4 until said upwardly bent parts 13 of the sheet metal portion 1 or 13-14-15 of the sheet metal portion 1' impact and indent the walls of chambers 53*a*, 53*b* thereby resulting at a firm connection of the hollow profile members 50 and alignment of the joint due to its symmetrical arrangement on either side of the plane of symmetry xx'.

The invention claimed is:

1. A joint for angular connection of hollow profile members (50) to form door/window profile frames, wherein edges of the hollow profile members (50) are cut at an angle to obtain a matching contact following assembly thereof along a plane of symmetry (xx') passing through a plane of matching contact of the cut edges of said hollow profile members (50), the joint comprising:

a slide base portion (2, 2', 2") having an angular configuration corresponding to an angle formed between a pair of connected hollow profile members (50), with an upper first base (20) with a centrally located cavity (20*a*) and with first side parts symmetrically extending on either side of said upper first base (20), each of said first side parts comprising a first section (21) extending into a second upwardly sloped section (22), each of said first side parts having outer planar surfaces (24, 25) configured to slidably contact a wall of each of a pair of chambers (53*a*, 53*b*) of the hollow profile members (50);

a sheet metal mobile portion (1, 1') having an upper second base (10) with a centrally located through hole (10*a*) and second side parts symmetrically extending on either side of said upper second base (10), each of said second side parts comprising a first planar side surface (11) extending into an inwardly bent second planar side surface (12), said first planar side surface (11) with a length equivalent to a length of said first section (21) and said inwardly bent planar side surface (12) with a length generally equivalent to a length of said second upwardly sloped section (22) of said slide base portion (2, 2', 2"), said second side surface (12) extending into an upwardly bent terminal side surface (13) oriented in a direction parallel to the plane of symmetry (xx') and terminating at sharp edges (16), said sharp edges (16) adapted to produce an indentation effect into walls of chambers (53*a*, 53*b*), said sheet metal mobile portion (1, 1') superimposed onto said slide base portion (2, 2', 2") so that said second base (10) is oriented parallel above said underlying first base (20), said first and second side parts symmetrically arranged on either side of the plane of symmetry (xx') passing through the plane of matching contact of the cut edges of said hollow profile members (50), and a bolt and nut assembly comprising a nut (4) fitted within said centrally located cavity (20*a*) of said slide base portion (2, 2', 2") and a bolt (5) adapted to pass through a hole (51*a,b*) of the hollow profile members (50) lying at said plane of symmetry (xx') and through said through hole (10*a*) of said sheet metal mobile portion (1, 1') and fastenable to said nut (4) to exert an upwardly pushing force onto said sheet metal mobile portion (1, 1') initiating sliding of said second side surfaces (12) thereof onto said second section (22) of said slide base portion (2, 2', 2") and lifting of said sheet metal mobile portion (1, 1') until said sharp edges (16) thereof indent the walls of chambers (53*a*, 53*b*) of the connected hollow profile members (50), wherein said second section (22) of said slide base portion (2, 2', 2") extends into an upwardly bent terminal side surface (23) oriented in a direction parallel to the plane of symmetry (xx'), said second section (22) and said upwardly bent terminal side surface (23) defining a socket (22-23), said second side surface (12) and upwardly bent terminal side surface (13) on either side of said mobile portion (1, 1') nested within said socket (22-23) on either side of said slide base portion (2, 2', 2");

each one of said sharp edges (16) of said sheet metal mobile portion (1, 1') comprising an edge (16*c*) adapted to contact and produce an indentation effect into the walls of chambers (53*a*, 53*b*), said edge (16*c*) formed through alignment in the longitudinal direction of said mobile portion (1, 1') of an aberrant sharp edge (16*a*) resulting from a cutting blade driven perpendicularly into a web of the sheet metal used in the manufacture of said sheet metal mobile portion (1, 1');

said sheet metal mobile portion (1, 1') having a structure that complies with a set of geometrical parameters:

an angle (a) formed by each of said upwardly bent terminal side surfaces (13) of the sheet metal mobile portion (1, 1') with a corresponding wall of each of the pair of chambers (53*a*, 53*b*) of the hollow profile members (50) whereupon said slide base portion (2, 2', 2") is mounted, and having a minimum value of 45°;

an angle (b) measuring 60° and formed by an inner wall of each one of the pair of chambers (53*a*, 53*b*) of the hollow profile members (50) whereupon said slide base portion (2, 2', 2") is mounted, and having a straight line passing through a terminal point (E1) of contact of the inwardly bent said second side surface (12) of the sheet metal mobile portion (1, 1') with said second section (22) of said base portion (2, 2', 2") and through a terminal point (E2) of impact of said sharp edge (16) of said sheet metal mobile portion (1, 1') respectively onto the opposing wall of chambers (53*a*, 53*b*) of the connected hollow profile members (50), and an angle (c) formed by a wall of chambers (53*a*, 53*b*) of the hollow profile members (50) indented by the sheet metal mobile portion (1, 1') with a line transversally crossing said sharp edge (16) of the sheet metal mobile portion (1, 1'), and having a value with a range of 45°-55°.

2. The joint according to claim 1, wherein said sheet metal mobile portion (1, 1') is a sheet metal mobile portion (1) comprising the linear upwardly bent terminal side surfaces (13), said sheet metal mobile portion (1) used in the connection of hollow profile members (50) with chambers (53*a*, 53*b*) having a width with a range of 10-12 mm.

3. The joint according to claim 1, wherein said sheet metal mobile portion (1, 1') comprises the linear upwardly bent terminal side surfaces (13), each of said upwardly bent terminal side surfaces (13) extending at a zigzag extension (14-15) adapted to shift a line of impact and indentation of the sheet metal mobile portion (1') in a direction away from the plane of symmetry (xx'), said zigzag extension (14-15) comprising a first segment (14) provided past a first bending point located at the end of said upwardly extending terminal side surface (23) of said slide base portion (2, 2', 2"), said first segment (14) bent outwardly through a predetermined arc in a direction away from the plane of symmetry (xx') and a second segment (15) provided past a second bending point located at the end of the outwardly bent said first segment (14), said second segment (15) bent inwardly through an equivalent said predetermined arc in a direction of rapprochement of the plane of symmetry (xx'), said sheet metal mobile portion (1') used in the connection of hollow profile members (50) with chambers (53*a*, 53*b*) having a width with a range of 13-25 mm.

4. The joint according to claim 1, wherein said slide base portion (2, 2', 2") comprises said upper first base (20) configured in an obtuse angle and said sheet metal mobile portion (1, 1') comprises said upper second base (10) configured in an analogous obtuse angle adapted to be mounted onto said upper first base (20) of said slide base portion (2, 2', 2"), said outer planar surfaces (24, 25) forming an angle corresponding to the angle formed between the hollow profile members (50) brought in matching contact and adapted to slide in abutment with the walls of respective chambers (53*a*, 53*b*) of the connected hollow profile members (50), an indentation (45) provided at the vertex of said angle formed by the outer planar surfaces (24, 25), said indentation (45) adapted to avert an inconveniency in sliding contact of said outer planar surfaces (24, 25) abutting on the walls of the chambers 53*a*, 53*b* of the connected hollow profile members (50).

5. The joint according to claim 4, wherein said slide base portion (2, 2', 2") further comprises an additional base raising member (3) with an angular configuration identical to said angular configuration of said slide base portion (2), said additional base raising member (3) comprising a pair of intersecting sides with outer planar surfaces (34, 35) abutting on the walls of the chambers (53*a*, 53*b*) of the connected hollow profile members (50), a leg member (36) extending upwardly along the plane of symmetry (xx') from a line of intersection of said outer planar surfaces (34, 35), said leg member (36) having a top edge (30) configured in an oblique angle adapted to fit within said slight indentation (45) provided along the line of intersection of said outer planar surfaces (24, 25) of the base portion and leg members (37, 38) provided symmetrically on either side of said leg member (36), said leg members (37, 38) extending perpendicularly upwardly from said outer planar surfaces (34, 35) respectively and provided with a platform (32) extending at a curvilinear lateral edge (33) at the top thereof, said platform (32) and curvilinear lateral edge (33) thereof adapted to provide mounting thereupon of said sockets (22-23) provided on either side of the base portion (2).

6. The joint according to claim 1, wherein said slide base portion (2, 2', 2") has an angular configuration that corresponds to an angle formed between a pair of connected hollow profile members (50), with outer planar surfaces (24, 25) including said slight indentation (45) at a region of intersection thereof, an upper first base (20) with a centrally located cavity (20*a*) adapted to fixedly support said nut (4) and with sockets (22-23) symmetrically extending on either side of said first base (20) adapted to provide nesting of said second planar side surface (12) and of said upwardly bent terminal side surface (13) on either side of said mobile portion (1, 1'), said slide base portion (2') further comprising a leg member (26) extending upwardly along the line of intersection of said outer planar surfaces (24, 25) and provided with said upper first base (20) at the top thereof and leg members (27, 28) provided symmetrically on either side of said leg member (26), said leg members (27, 28) extending perpendicularly upwardly from said outer planar surfaces (24, 25) respectively and provided with said sockets (22-23) at the top thereof.

7. The joint according to claim 6, further comprising an additional base raising member (3) with an angular configuration identical to said angular configuration of said slide base portion (2'), said additional base raising member (3) comprising a pair of intersecting sides with outer planar surfaces (34, 35) abutting on the walls of the chambers (53*a*, 53*b*) of the connected hollow profile members (50), a leg member (36) extending upwardly along the plane of symmetry (xx') from a line of contact of said outer planar surfaces (34, 35), said leg member (36) having a top edge (30) configured in the shape of an oblique angle adapted to fit within said slight indentation (45) provided along the plane of intersection of said outer planar surfaces (24, 25) of said slide base portion (2') and leg members (37, 38) provided symmetrically on either side of said leg member (36), said leg members (37, 38) extending perpendicularly upwardly from said outer planar surfaces (34, 35) respectively and abutting on said outer planar surfaces (24, 25) of said slide base portion (2').

8. The joint according to claim 1, wherein said slide base portion (2, 2', 2") is a slide base portion (2") having an angular configuration that corresponds to an angle formed between a pair of connected hollow profile members (50), said slide base portion (2") comprising an upper first base (20) and sockets (22-23) symmetrically extending on either side of said first base (20) adapted to provide nesting of said second planar side surface (12) and upwardly bent terminal side surface (13) on either side of said mobile portion (1, 1') superimposed onto said slide base portion (2'), said slide base portion (2') extending at side members (41, 42) adapted to fit within the chambers (53*a*, 53*b*) respectively of the connected hollow profile members, recesses (43, 44) respectively provided transversally along the surfaces of said side members (41, 42), said recesses (43, 44) adapted to receive strips of material of the walls of the chambers (53*a*, 53*b*) respectively cut through cutting blades applied exteriorly of the hollow profile members (50), said strips embedded within the recesses (43, 44) thereby enhancing stabilization of said side members (41, 42) within the chambers (53*a*, 53*b*) of the connected hollow profile members (50) in addition to the indentation of said sharp edges of the sheet metal mobile portion (1, 1') into the walls of chambers (53*a*, 53*b*).

9. The joint according to claim 1, wherein said hole (51*a,b*) of the hollow profile members (50) lies along said plane of symmetry (xx') and is adapted to receive a key (51) used in a tightening process of said bolt (5) comprises a first half hole (51*a*) medially along a first edge of chamber (53*a*) and a second half hole (51*b*) medially along a second edge of chamber (53*b*).

10. A method for using the joint of claim 1 for the angular connection of hollow profile members (50) to form door/window profile frames, the method comprising:

a. Cutting the edges of the hollow profile members (50) adapted to angularly connect at an angle having half a value of an intended angle of connection thereof, the plane of symmetry (xx') passing through the plane of matching contact of said connected hollow profile members (50), and drilling the hole (51*a,b*) comprising a first half hole (51*a*) located centrally along the edge of a chamber (53*a*) of a first one of the connected hollow profile members (50) and a second half hole (51*b*) located centrally along the edge of a chamber (53*b*) of a second one of the connected hollow profile members (50), wherein said hole (51*a,b*) is adapted to receiving a key (51) used for tightening the bolt (5) provided along said plane of symmetry (xx');

b. Selecting a slide base portion (2) or (2') with or without an additional base raising member (3) appropriately corresponding to the width of the chambers (53*a*, 53*b*) of the connected hollow profile members or a base portion (2") in combination with a sheet metal portion (1) or (11 and performing assembly of the joint through driving of the bolt (5) through the through hole (10*a*) of the sheet metal portion (1) or (1') and screwing the same into the nut (4) mounted onto the slide base portion;

c. Introducing a first half of the assembled joint into the chamber (53*a*) of the first one of the connected hollow profile members (50);

d. Bringing the chamber (53*b*) of the second one of the connected hollow profile members (50) into matching contact with chamber (53*a*) of the first one of the connected hollow profile members (50) and inserting a second half of the assembled joint that projects outwardly from chamber (53*a*) into the chamber (53*b*), whereby a matching contact of said first and second connected hollow profile members (50) is obtained and the hole (51*a,b*) is formed through abutment of matching half holes (51*a*) and (51*b*);

e. Inserting the key (51) through the hole (51*a,b*) and rotation thereof for screwing the bolt (5) into the nut (4) until said upwardly bent parts (13) of the sheet metal mobile portion (1) or upwardly bent parts (13-14-15) of the sheet metal portion (1') impact and indent the walls of chambers (53*a*, 53*b*) thereby providing a firm connection of the connected hollow profile members (50) and alignment of the joint due to its symmetrical arrangement on either side of the plane of symmetry (xx').

* * * * *